US007169004B2

(12) United States Patent
Johnson et al.

(10) Patent No.: US 7,169,004 B2
(45) Date of Patent: Jan. 30, 2007

(54) APPARATUS AND METHOD FOR PLACING SPACERS IN AN EMISSIVE DISPLAY

(76) Inventors: Scott V. Johnson, 5111 E. Sharon Dr., Scottsdale, AZ (US) 85254-3636; Carl R. Hagen, 6439 W. Laredo St., Chandler, AZ (US) 85226

( * ) Notice: Subject to any disclaimer, the term of this patent is extended or adjusted under 35 U.S.C. 154(b) by 156 days.

(21) Appl. No.: 11/116,661

(22) Filed: Apr. 27, 2005

(65) Prior Publication Data

US 2006/0246809 A1 Nov. 2, 2006

(51) Int. Cl.
*H01J 9/00* (2006.01)

(52) U.S. Cl. ..... 445/24; 445/37; 445/47; 445/49

(58) Field of Classification Search ..... 445/24, 445/37, 47, 49
See application file for complete search history.

(56) References Cited

U.S. PATENT DOCUMENTS 6,000,981 A * 12/1999 Knox et al. ..... 445/24
6,863,585 B2 * 3/2005 Yang et al. ..... 445/24

* cited by examiner

*Primary Examiner*—Joseph Williams

(57) ABSTRACT

An apparatus (10) for, and method of, placing a plurality of spacers (12) between a parallel opposed anode and cathode (20) of an emissive display includes temporarily securing, by applying a vacuum for example, a first side of one of the anode or cathode to a base (14) having a plurality of electromagnets (16) positioned therein. The electromagnets (16) attract a first side of each of the plurality of spacers (12), thereby positioning each of the spacers (12) in a desired location on a second side of the one of the anode or cathode (20). The spacers (12) may be provided from a shuffling tray (40) having a plurality of openings (42), each opening (42) approximately aligned with one of the electromagnets (16) and shaped so as to present the first side to the electromagnet (16) to the one of the anode or cathode (20).

20 Claims, 4 Drawing Sheets

APPARATUS AND METHOD FOR PLACING SPACERS IN AN EMISSIVE DISPLAY

FIELD OF THE INVENTION

The present invention generally relates to emission displays, and more particularly to a structure for, and method of, affixing spacers in field emission displays.

BACKGROUND OF THE INVENTION

Spacers for field emission displays are known in the art. A field emission display includes an envelope structure having an evacuated interspace region between two display plates. Electrons travel across the interspace region from a cathode plate, upon which electron emitter structures, such as Spindt or carbon nanotubes, are fabricated, to an anode plate which includes deposits of light-emitting materials, or phosphors. Typically the pressure within the interspace region is less than or equal to $10^{-6}$ Torr.

The cathode plate and anode plate are thin in order to provide low display weight. These thin plates are not structurally sufficient to prevent collapse or bowing upon evacuation of the interspace region. Spacers are structures positioned between the anode and the cathode plate to provide standoff. As a result of the atmospheric pressure, spacers play an essential role in lightweight displays. The spacers, in conjunction with the thin, lightweight plates, support the atmospheric pressure allowing the display area to be increased with little or no increase in plate thickness.

Several schemes have been proposed for providing spacers. Some of these schemes include the affixation of structural members to the inner surface of a display plate, particularly, the anode plate. Such prior art schemes include the heating of the display plate and spacer in order to bond the spacer to the display plate. Such schemes require bonding spacers to the anode plate due to its robustness in heating and oxidizing environments compared to the cathode plate. This method has the disadvantage of spacer misalignment when contacting the cathode resulting in destruction of emitters and shorted column or row conductors. Other disadvantages of prior art schemes include large processing times required to heat display plate and spacers, oxidation of cathode bonding metals associated with high temperatures and glues thereby impacting the quality of the vacuum, and contamination caused by elaborate pick and place equipment required for spacer placement. Furthermore, the spacers may be troublesome to keep in an upright position while installing the second plate, and the pick and place method consumes valuable time, perhaps as much as 30 minutes for a large array.

Accordingly, it is desirable to provide an improved method of affixing, spacers in field emission displays. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

An apparatus for, and method of, placing a plurality of spacers between a parallel opposed anode and cathode of an emissive display. The apparatus temporarily secures, by applying a vacuum for example, a first side of one of the anode or cathode to a base having a plurality of electromagnets positioned therein. The electromagnets attract a first side of each of the plurality of spacers, thereby positioning each of the spacers in a desired location on a second side of the one of the anode or cathode.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
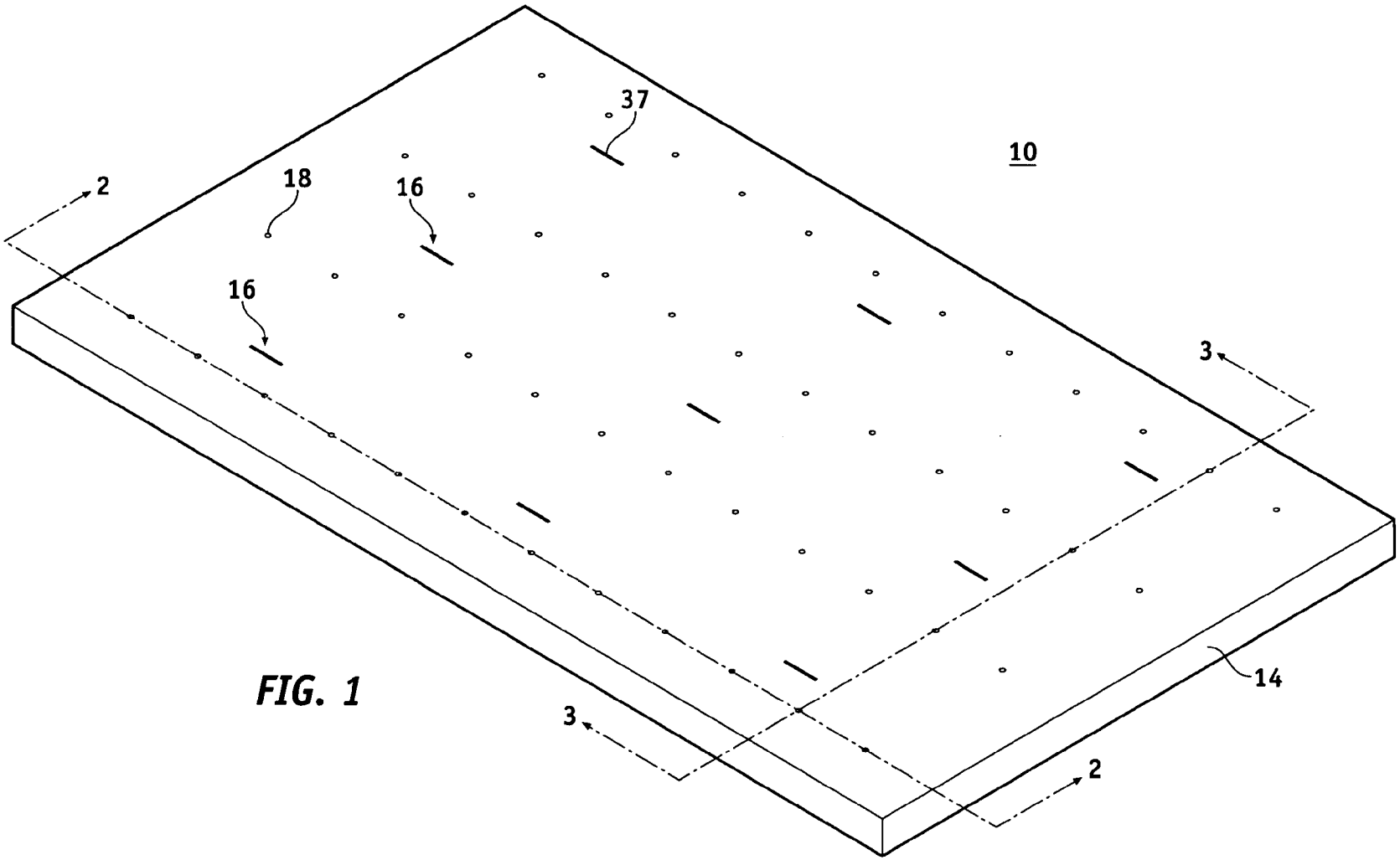
FIG. 1 is an isometric view of a preferred embodiment of the present invention.
Figure 2:
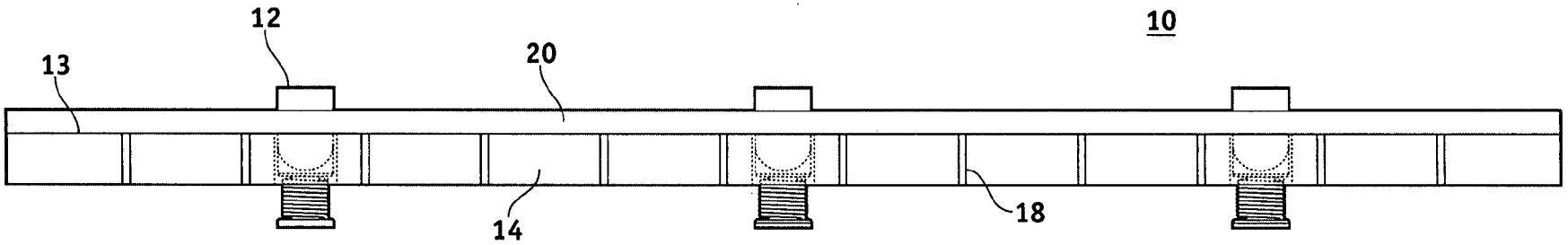
FIG. 2 is a cross-sectional view taken along line 1—1 of the preferred embodiment of FIG. 1.
Figure 3:
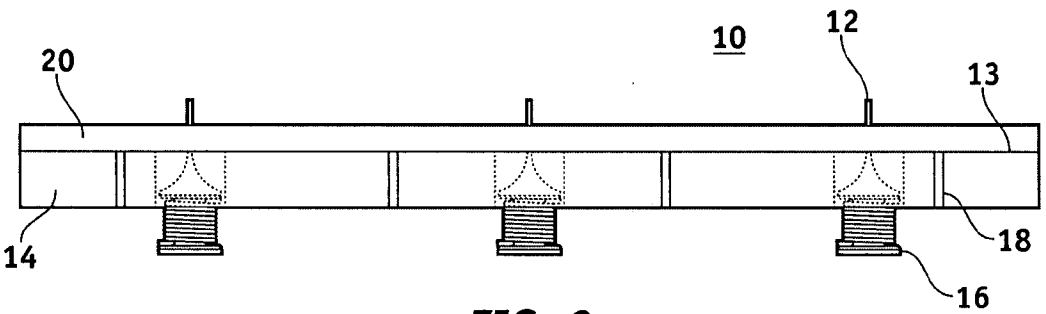
FIG. 3 is a cross-sectional taken along line 2—2 of the preferred embodiment of FIG. 1.

Referring to FIGS. 1–3, the apparatus 10 in accordance with a preferred embodiment of the invention provides a method for providing separation between a cathode and anode of an emission display by placing spacers 12 in the evacuated interspace region between the anode and cathode. A base 14 is configured for securing a plurality of electromagnets 16. The base 14 may comprise any type of material such as plastic or ceramic, but preferably would comprise a thermoset plastic in order to ensure dimensional stability. While a three by three array of electromagnets 16 is shown for simplicity of description, the number of electromagnets 16 would depend on the number of spacers 12 required, which would depend on the size of the cathode/anode of the emissive display and could number in the hundreds. A plurality of vacuum holes 18 are positioned through the base 14 for attracting and securing the anode 20 temporarily in place around the base 14 while placing the spacers 12.

Figure 4:
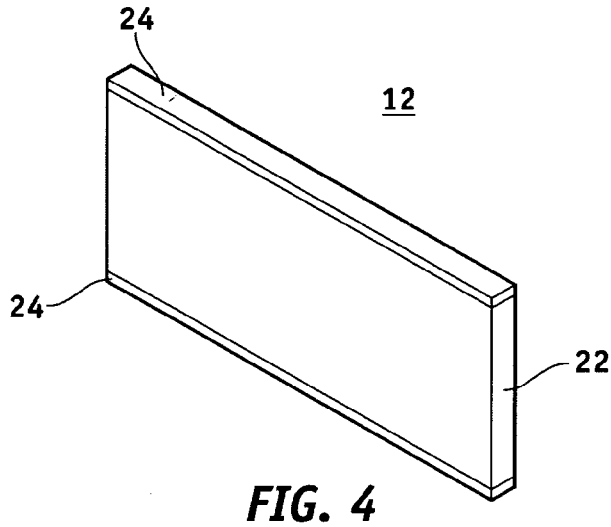
FIG. 4 is an isometric view of a spacer placed in accordance with the preferred embodiment of the present invention.

A spacer 12 is shown in FIG. 4 and comprises a rigid portion 22 and a metalized portion 24 on opposed sides. The rigid portion 22 comprises a dielectric material to prevent conduction between the sides, or metalized portions 24, and preferably comprises a ceramic material. The metalized portions 24 comprise any metal that would be attracted to the electromagnet 16, and preferably comprise nickel, iron, or a ferrous alloy. The spacer 12 preferably comprises dimensions of 1 centimeter by 1.8 millimeters by 0.5 millimeters, with the 1.8 millimeters dimension stretching along both the anode and cathode.

Figure 5:
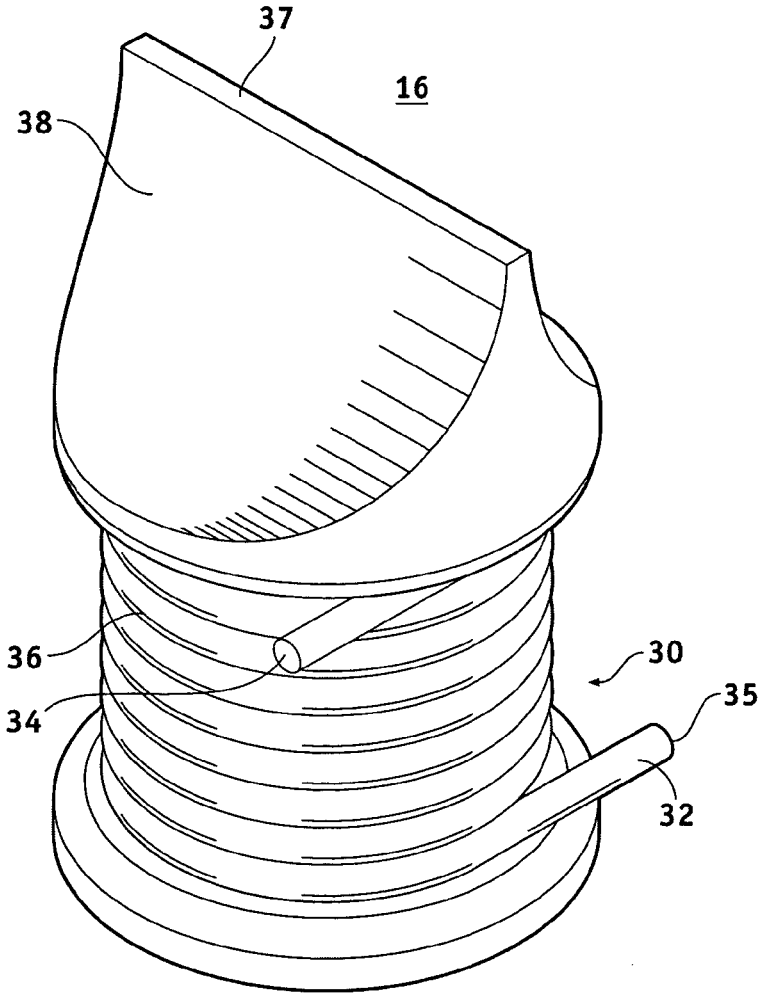
FIG. 5 is an isometric view of an electromagnet included in the preferred embodiment of FIG. 1.

Referring to FIG. 5, the electromagnet 16 shown in FIGS. 1–3 comprises a column portion 30 having a conductor 32 wrapped therearound. The conductor 32 has first 34 and second 35 ends that are coupled to a current source (not shown). When current flows through the conductor 32 and in the coil 36 formed around the column portion 30, an electromagnetic field is created in a manner well known to those skilled in the art. A receiving portion 38 integral to the column portion 30 is shaped to receive, while magnetically attracting, one of the metalized portions 24 of the spacer 12. The end 37 of the receiving portion 38 preferably is flush with, or occupies the same plane as, the first surface 13 of the base 14, but may be recessed within the base 14.

Figure 6:
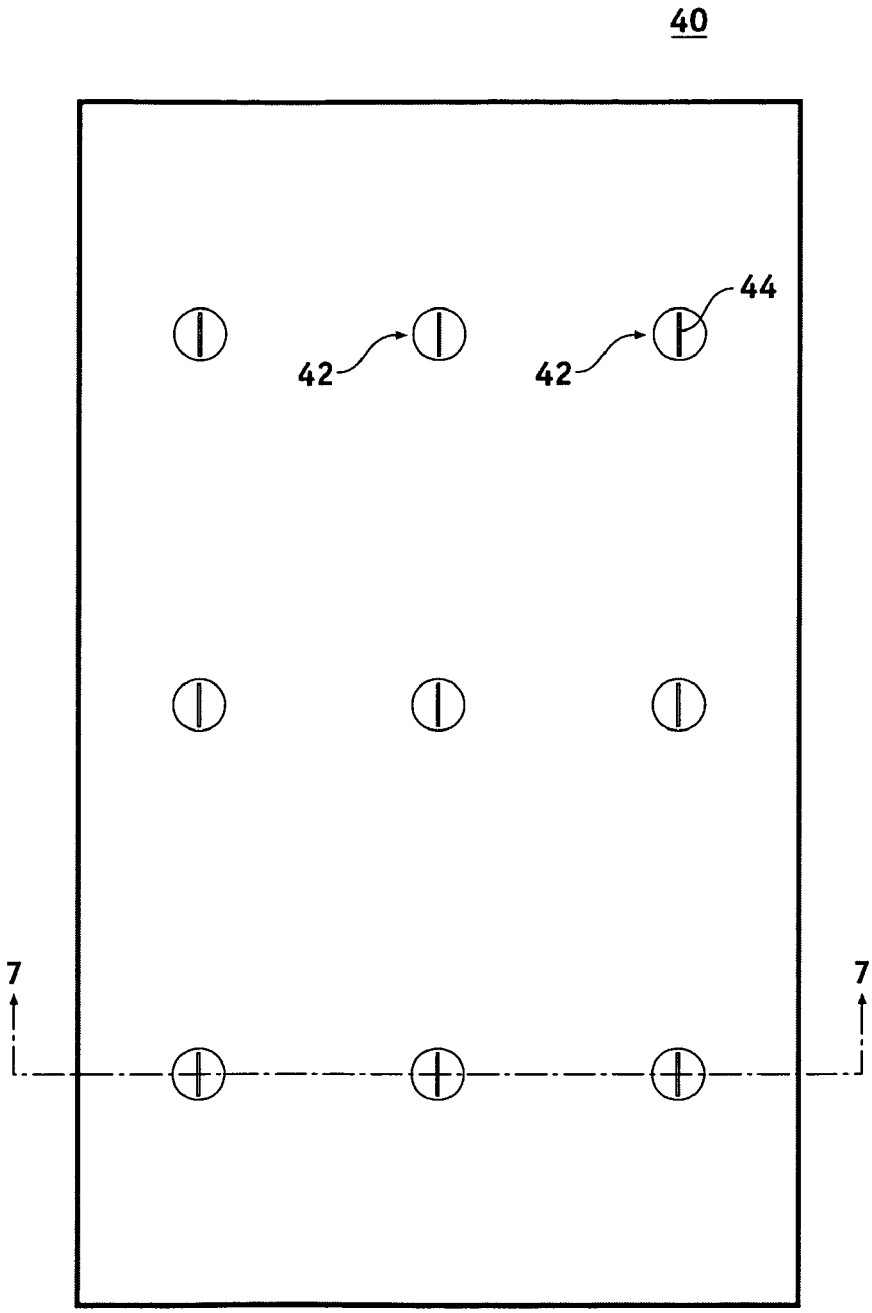
FIG. 6 is a top view of a shuffle table used in the preferred embodiment of the present invention.
Figure 7:
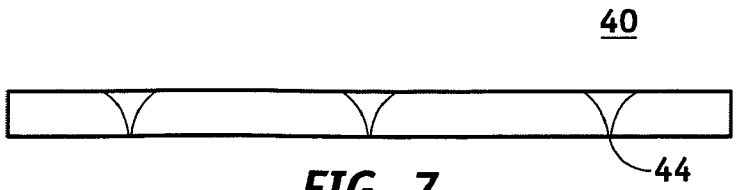
FIG. 7 is a cross-sectional view taken along line 7—7 of FIG. 6.

The spacers 12 may be individually guided to the electromagnet 16 by the shuffle tray 40 illustrated in FIGS. 6 and 7. A device (not shown) drops a spacer 12 into each of the openings 42 in the shuffle tray 40. As the spacer 12 passes through the opening 42, it is repositioned, if necessary, by the shape of the opening 42 so one of the metalized portions 24 is aligned, as it passes out of the shaped end 44, with the receiving portion 36. The magnetism created by the electromagnet 16 ensures the spacer is accurately positioned in the desired position and in an upright position so the other metalized portion 24 is positioned to receive the other of the anode or cathode. The shuffle tray 40 may be shaken, or vibrated, to facilitate the spacer 12 passing through the opening 42 and out the shaped end 44 in the desired orientation. The shuffle tray 40 may then be moved before positioning the other of the anode or cathode on the spacers 12.

If one or more spacers 12 are positioned incorrectly (misaligned), the apparatus 10 may be subjected to a localized vacuum from above and a selected one or more of the electromagnets 16 may be de-activated. The localized vacuum will then cause the spacer to be pulled from its position. The placing process may then be repeated for that specific location on the anode 20.

The invention described herein provides, in view of known art, improved accuracy in placement in a desired location, reduced contaminants that may degrade the emitters and the vacuum, less consumption of time in placement of the spacers, proper orientation of one or more spacers, and a way of correcting misplacement of the spacers.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

The invention claimed is:

1. A method of placing a plurality of spacers between a parallel opposed anode and cathode of an emissive display, comprising:

temporarily securing a first side of one of the anode or cathode to a base having a plurality of electromagnets positioned therein; and magnetically attracting a first side of each of the plurality of spacers to one of the electromagnets, thereby positioning each of the spacers in a desired location on a second side of the one of the anode or cathode.

2. The method of claim 1 further comprising bonding the first side of the spacer to the one of the anode or cathode.

3. The method of claim 1 further comprising bonding the other of the anode or cathode to a second side of the spacer.

4. The method of claim 1 wherein the temporarily securing comprises attracting the first side of the anode or cathode to the base by a vacuum exerted through a plurality of openings in the base.

5. The method of claim 1 further comprising positioning each of the spacers so the first side thereof may be attracted by one of the electromagnets.

6. The method of claim 1 wherein the positioning comprises shuffling the spacers in a tray having a plurality of openings, each approximately aligned with one of the electromagnets and shaped so as to present the first side to the electromagnet.

7. An apparatus for placing spacers on one of an anode or cathode of an emissive display, comprising:

a base having a first side for receiving the anode or cathode and having a plurality of openings therethrough for presenting a vacuum existing on a second side to the first side to draw the anode or cathode into contact with the first side; and a plurality of electromagnets coupled to terminals for receiving a voltage, each positioned within the base to exert a magnetic pull through the anode or cathode to attract and position one of the spacers.

8. The apparatus of claim 7 further comprising a shuffle tray having a plurality of openings therethrough, each opening for receiving one of the spacers and positioning the spacer for placement onto the anode or cathode on a side opposed to the base and so as to line up with and be magnetically attracted to one of the plurality of electromagnets.

9. The apparatus of claim 7 further wherein the other of the anode or cathode are positioned against a side of the spacer opposed to the side attracted by the electromagnet.

10. The apparatus of claim 7 wherein each spacer comprises a rigid center portion of a ceramic material and two opposed sides of metal.

11. The apparatus of claim 7 wherein each spacer has a first side comprising a metal that is attracted by the electromagnet.

12. The apparatus of claim 11 wherein the metal comprises one of a nickel, iron, ferrous alloy, or a combination thereof.

13. The apparatus of claim 11 wherein the metal bonds the spacer to the one of an anode or a cathode.

14. The apparatus of claim 7 wherein the electromagnet comprises a first column portion having a conductor coiled therearound and a receiving end that magnetically attracts one of the spacers when a current is passed through the conductor.

15. An apparatus for placing spacers on one of an anode or cathode of an emissive display, comprising:

a base having first and second sides and a plurality of opening therethrough, the first side receiving the anode or cathode, wherein the anode or cathode is drawn into contact with the first side by a vacuum existing on the second side; and a plurality of electromagnets coupled to terminals for receiving a voltage, each positioned within the base to exert a magnetic pull through the anode or cathode to attract and position one of the spacers thereon.

16. The apparatus of claim 15 further comprising a shuffle tray having a plurality of openings therethrough, each opening for receiving one of the spacers and positioning the spacer for placement onto the anode or cathode on a side opposed to the base and so as to line up with and be magnetically attracted to one of the plurality of electromagnets.

17. The apparatus of claim 15 further wherein the other of the anode or cathode are positioned against a side of the spacer opposed to the side attracted by the electromagnet.

18. The apparatus of claim 15 wherein each spacer comprises a rigid center portion of a ceramic material and two opposed sides of metal.

19. The apparatus of claim 15 wherein each spacer has a first side comprising a metal that is attracted by the electromagnet.

20. The apparatus of claim 15 wherein the electromagnet comprises a first column portion having a conductor coiled therearound and a receiving end that magnetically attracts one of the spacers when a current is passed through the conductor.

* * * * *